United States Patent [19]

Winterholler et al.

[11] 4,187,968

[45] Feb. 12, 1980

[54] APPARATUS FOR THREADING A PAPER WEB INTO THE FOLDING MECHANISM OF A ROTARY PRINTING PRESS

[75] Inventors: Johann Winterholler, Hugelshart; Josef Plantsch; Herbert Stockl, both of Augsburg; Siegfried Gunther, Munich, all of Fed. Rep. of Germany

[73] Assignee: Maschinenfabrik Augsburg-Nurnberg Aktiengesellschaft (M.A.N.), Augsburg, Fed. Rep. of Germany

[21] Appl. No.: 861,966

[22] Filed: Dec. 19, 1977

[30] Foreign Application Priority Data

Dec. 21, 1976 [DE] Fed. Rep. of Germany ..... 2657789

[51] Int. Cl.[2] ..... B65H 23/32

[52] U.S. Cl. ..... 226/92; 226/97; 226/197

[58] Field of Search ..... 226/91, 92, 97, 197

[56] References Cited

U.S. PATENT DOCUMENTS

| | | | |
|---|---|---|---|
| 3,548,783 | 12/1970 | Knapp | 226/197 X |
| 3,999,696 | 12/1976 | Reba | 226/91 X |
| 4,063,505 | 12/1977 | Sasamoto | 226/91 X |

*Primary Examiner*—Richard A. Schacher

*Attorney, Agent, or Firm*—Frishauf, Holtz, Goodman & Woodward

[57] ABSTRACT

To provide for automatic threading of a paper web throughout an entire printing press equipped with a press threading mechanism, and also over the folding former thereof, two paper guide baffles are located at the back side of the folding former extending in converging direction from the edges of the former to the tip thereof and up to the nip between a pair of take-up rollers located below, and adjacent the tip of the former. Air pressure differential generating means, typically air blast nozzles are directed towards the guide baffles to generate an under pressure adjacent to surfaces thereof which will pull paper downwardly into the nip between the take-up rollers. The take-up rollers themselves have a knurled, or ribbed surface and are driven by air blasts directed against the ribbing of the surface, to move paper which is guided over the folding former by the air blasts away and through the former mechanism. Thus, threading of the press can be done entirely automatically, eliminating the requirement of a pressman, threading the paper web over the former.

11 Claims, 7 Drawing Figures

APPARATUS FOR THREADING A PAPER WEB INTO THE FOLDING MECHANISM OF A ROTARY PRINTING PRESS

This invention relates to an apparatus for the threading of a paper web into the folding mechanism of a rotary printing press equipped with a former, or folding cone or triangle.

BACKGROUND AND PRIOR ART

U.S. Pat. Nos. 2,862,705, DDR (East Germany) DL-Pat. No. 43925 and BRD (Fed. Rep. Germany) DT-Pat. No. 2 241 127 describe apparatus for the mechanical threading of a paper web into the printing—drying—and cooling sections of rotary printing presses, by which the rapid, automatic insertion of the paper web into the starting position for the printing process is possible, with the danger of web tearing to a great extent eliminated.

In the arrangement of the U.S. Pat. No. 2,862,705 a pair of roller chains, one on each side of the paper web, running along the side of the provided path of insertion, are connected with an elastic cross ribbon to which the beginning of the web is attached. The system according to DDR Germany Patent comprises a roller chain with a latching clamp serving to grip the pointed end of the bias-cut paper web, on one side of the paper web only. In this design the relatively heavy pressure of the feed rollers prevents any deviation of the web from the straight path. The arrangement as per the DT-Patent employs also one roller-chain on the side only. This roller chain of a fixed length is being guided in a channel on the side of the printing press and is driven by a number of driving sheaves located at various points in this channel; by means of shunting switches located at different points in the channel insertion of the paper web can be accomplished at these points.

The printing press need not be altered to permit operation of these threading systems; they do not affect the set-up, thus permitting a speedy continuation of the printing process after a tearing of the web. They also result in a considerable reduction of the relatively high downtime required for the threading of a new web. However, they permit mechanized insertion of the web only up to the folding mechanism. Since the paper web is being folded lengthwise at the folding cone, or folding triangle, or former and due to the fact that the feed rollers downstream from the folding cone are perpendicular to the ones before this cone, it has up to now not been possible to devise a system for automatic threading into the folding mechanism. Rotary printing presses equipped with the above mentioned patented devices can be threaded into the folding mechanism only manually.

The beginning of the relatively wide paper web must be torn as square as possible (with respect to the edges of the web), and the web is then wrapped around the folding cone. To do this, the pressman has to place himself up on the frame of the machine, with his legs spread far apart. Thereafter he has to tap the two bottom feed rollers - one on each side of the wedge of the folding cone - with his hands to bring them into rotation and then to guide the paper web with both hands into the space between the two bottom feed rollers; in this manner the paper web which is being slowly transported by means of the folding roller ahead of the folding cone is gripped by the bottom feed rollers and can be transported to the next feed rollers. This operation is relatively time consuming; any benefit in the reduction in threading time—in itself arrived at only at considerable cost—is cancelled to a large extent. Also, the threading of the web is not always accomplished on the first try. But most of all, the manual threading can lead to serious accidents. Due to the limited accessibility to the folding cone the pressman's position is not secure; also he has to stretch far owing to the width of the paper web and he has to work fast since the machine is kept running continuously. Consequently it happens relatively frequently that he gets hurt when his fingers get caught between the two bottom feed rollers.

THE INVENTION

It is an object to provide an arrangement for the threading of a paper web into the folding mechanism of a rotary printing machine of the kind described above through the mechanization of the necessary steps in order to facilitate the threading for the pressman on one hand, and on the other hand to devise an automation of this procedure to be compatible with the mechanized threading system used on the section of the rotary printing press ahead of the folding section.

Briefly, on the rear side of the guide baffle of the folding cone, two auxiliary guide baffles are attached, extending from the two edges of the folding cone and meeting convergently in the space between the two bottom feed rollers; a vacuum is created on those auxiliary baffles which enables the movement of the beginning of the paper web from the edges of the folding cone in the direction toward the space between the two bottom feed rollers of the folding section. An intermittently driven arrangement for the two bottom feed rollers is provided, for subsequent continuation of the transport of the beginning of the paper web.

This method reduces the downtime periods of the rotary printing press, minimizes the danger of accident and thus substantially increases the safety of the operation. As an additional advantage this system permits the installation of an enclosure for the folding section, one of the noisiest parts of the rotary printing press, with the benefit of noise attachment, because the necessity for immediate access to the folding section has been eliminated.

In accordance with a feature of the invention, air-nozzles are attached on each side of the folding cone, at a distance from the plane of the guide baffle and from the auxiliary baffles used for the guiding of the paper web. These nozzles are mounted on such an incline against the auxiliary baffles that one component of the airstream is directed perpendicular to the spacing between the bottom feed rollers.

DRAWINGS, ILLUSTRATING AN EXAMPLE

Figure 1:
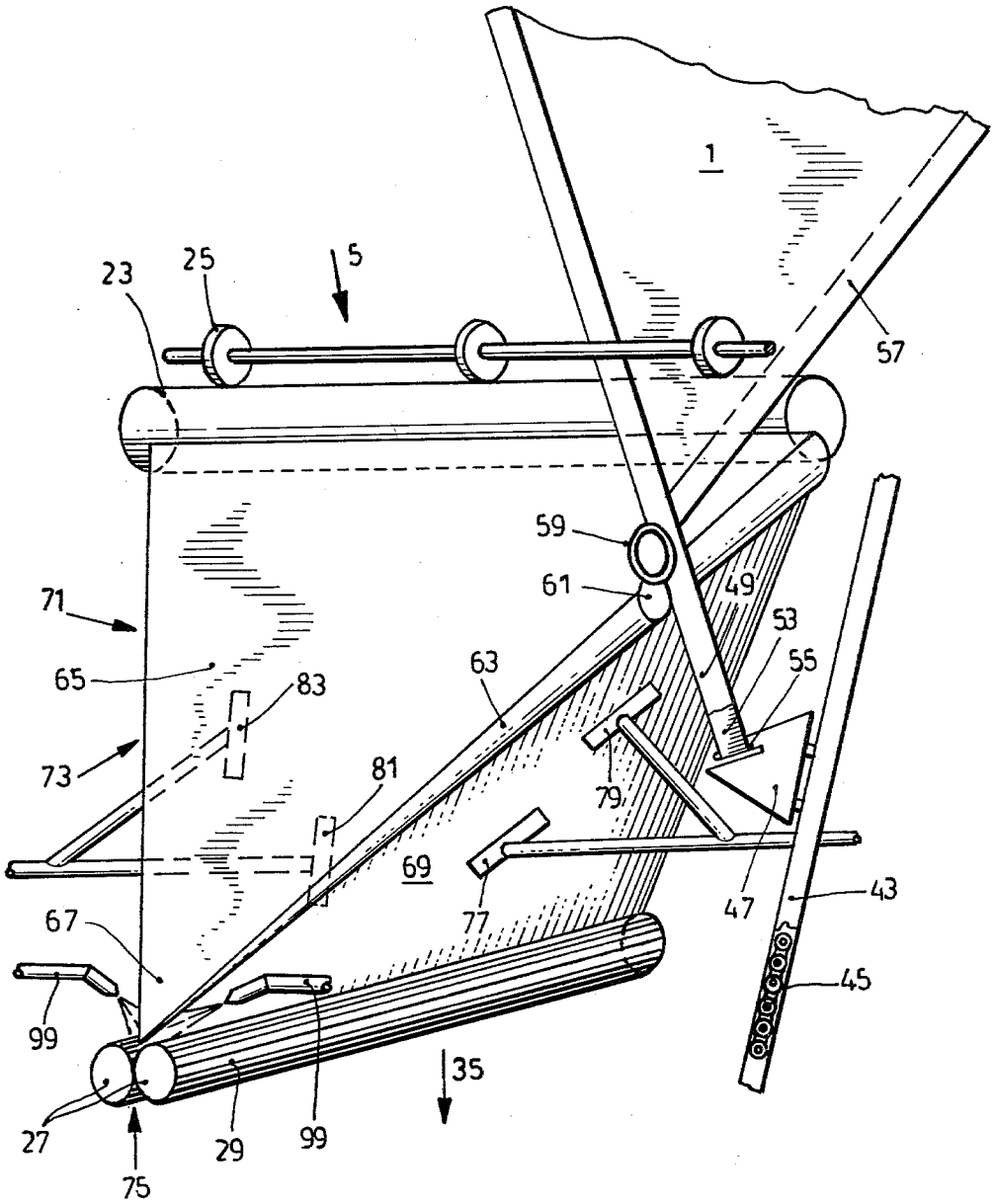
FIG. 1 is a frontal part perspective view of part of the folding cone of a rotary printing press with the particular embodiment of the invention.
Figure 1A:
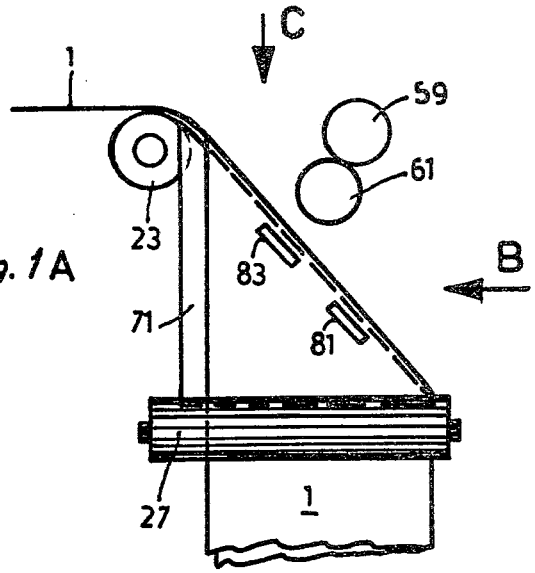
FIG. 1A is a highly schematic side view of a folding former or folding triangle of a construction generally similar to that of the prior art, and additionally showing elements of the present invention.
Figure 1B:
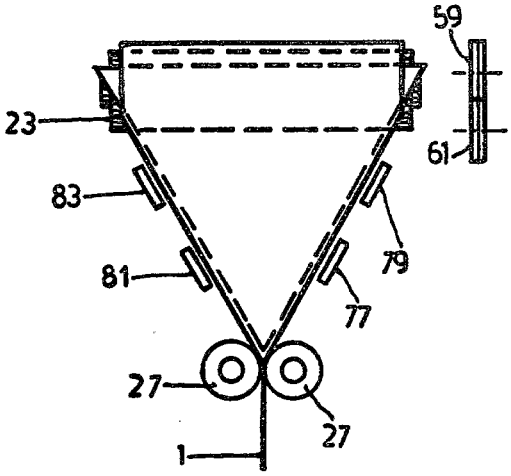
FIG. 1B is a front view of the folding former of FIG. 1A, and viewed along arrow B of FIGS. 1A, 1C and 1D.
Figure 1C:
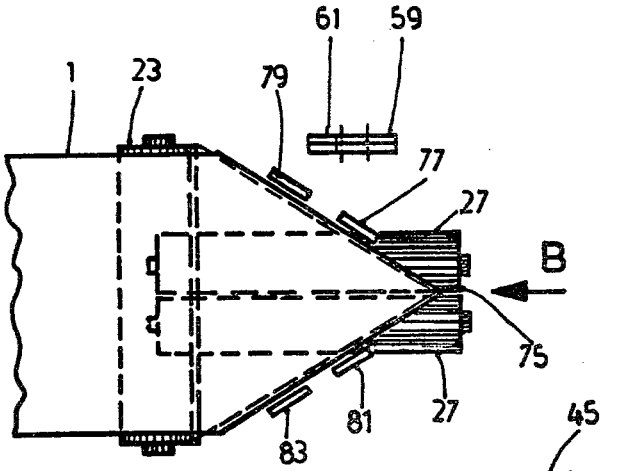
Figure 1D:
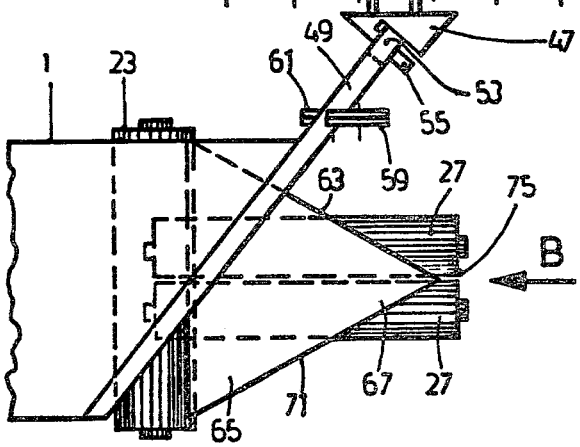
Figure 2:
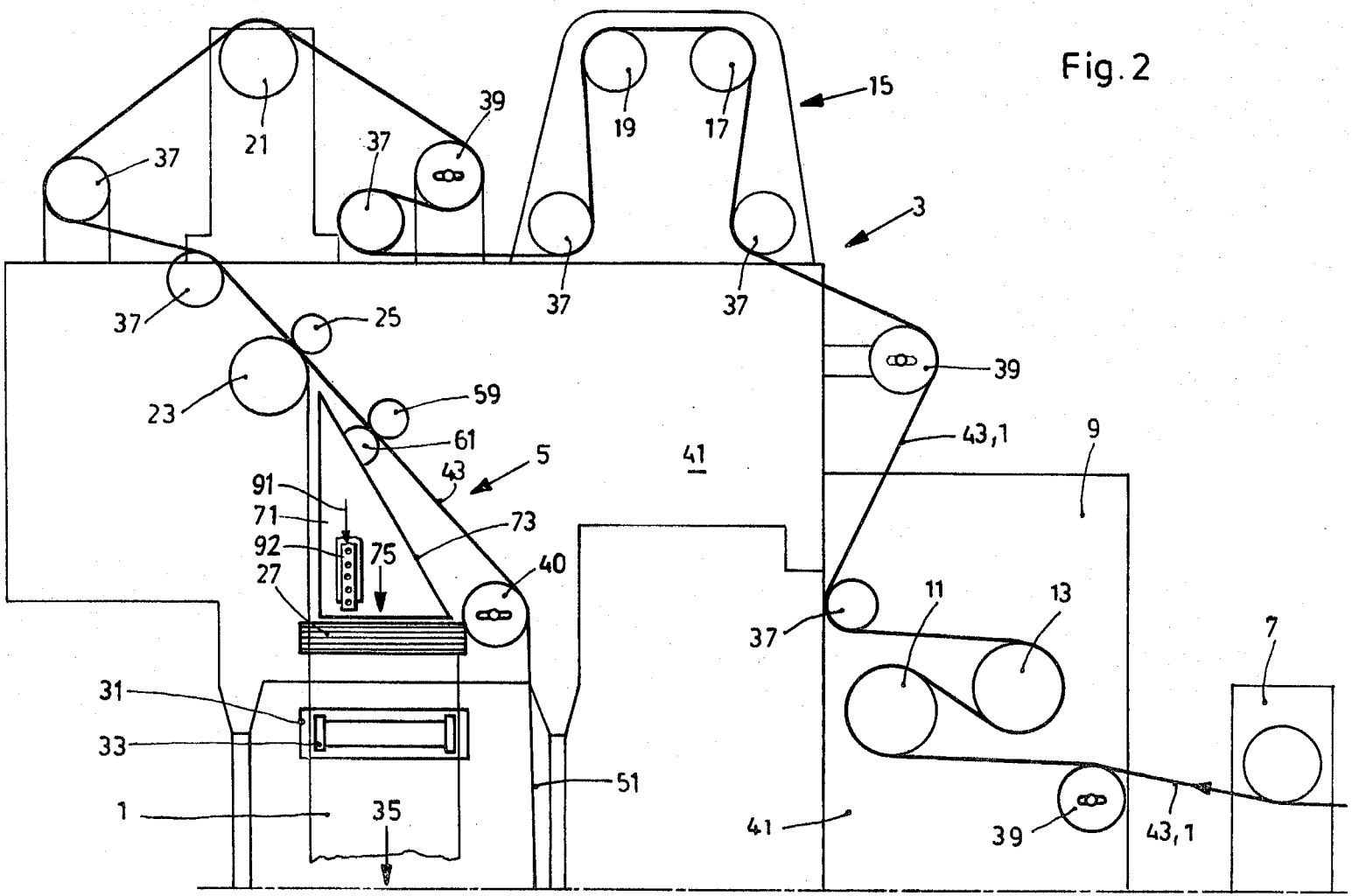

FIG. 1C is a top view of the folding former of FIG. 1A, in which the transport mechanism in accordance with the present invention has been omitted, and viewed along arrow C of FIG. 1A; and FIG. 1D is a view similar to FIG. 1C showing the additional features in accordance with the present invention for automatic transport of a paper web through the folding station of a printing press, and viewed along arrow C of FIG. 1A;

FIG. 2 is a side view of the rear section of said rotary printing press.

Figure 3:
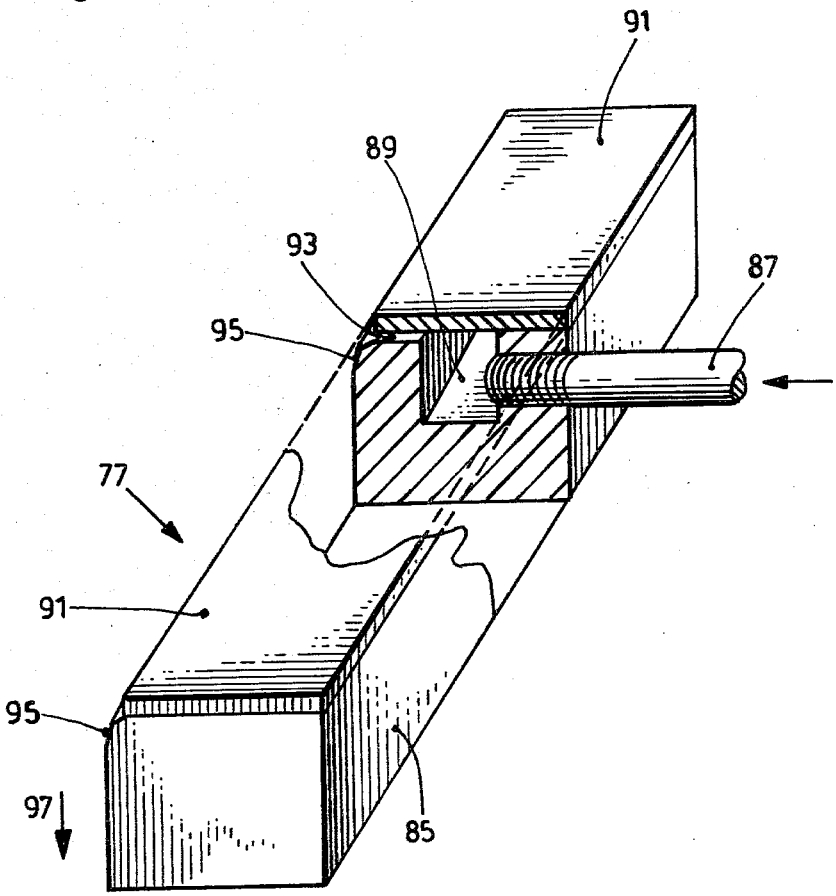

FIG. 3 is an oblique view of the nozzle manifold used on the arrangement under FIG. 1.

In FIG. 2 is shown the rear segment of a rotary printing press, illustrated in the direction of the path of the paper web 1, with a transport section 3, and a folding section 5. After leaving the drying oven 7 the paper web enters into a cooling chamber 9 comprising two cooling drums 11 and 13 and then, after first passing through an alignment regulator 15 with two alignment rollers 17 and 19 subsequently over a measuring roller 21 for desitometrical purposes - the paper web enters into the folding apparatus 5 itself. Ahead of the folding apparatus 5 is a driven folding roller 23 against which the paper web 1 is pressed by means of pressure rollers 25. Situated after the folding section 5 are two bottom feed rollers 27 with their rotary axes perpendicular to the previously described rollers 17 to 25 and provided with a number of sharp knurls on the outershell, parallel to the direction of the axis. The paper web 1 passes finally through a pair of rollers consisting of a pull-off roller 31 and a pressure roller 33 before entering into a cross folding apparatus 35; the latter is not shown here. On its passage through the machine the paper web 1 is carried over various guide rollers 37 and 39.

After passing the folding roller 23 the paper web 1 is still in its original width. The folding section imparts a longitudinal fold to the paper web 1 and this fold is compressed by the lower folding rollers 27 so that the paper web 1 now enters into the roller assembly 31 and 32 folded in half of its original width. By conventional methods the paper web 1 is then cut into individual segments which are subsequently stacked, cross-folded and stored.

Up to the upper folding roller 23 the axes of all rollers, drums and cylinders of the rotary printing machine are parallel to each other. Up to this point it is also possible to thread the printing press automatically. For this purpose a U-shaped guide channel 43 is provided running basically identically to the paper path as far as the view of this drawing is concerned.

A roller chain 45 (FIG. 1 FIG. 1D) extending at least from one guide roller 39 to the next guide roller 39 and driven by driving sheaves provided on every guide roller 39 is carried in the guide channel 43. A threading latch 47 is attached to the end of the roller chain 45 into which a strip of adhesive tape 49 is hooked, which in turn is affixed to the beginning of the paper web 1.

By means of this roller chain 45 as a threading device it is possible to thread the paper web 1 automatically up to the upper folding roller 23. Arcs of contact of almost 360° as shown in FIG. 2 at the cooling drums 11 and 13 can be managed without difficulty. However this method cannot be applied to the lower folding rollers 27 and therefore it was necessary up to now to thread the paper web 1 manually over the folding cone of the folding section 5 toward the lower folding rollers 27. At this point the paths of the paper web 1 and of the guid channel 43 separate: - the paper web enters into the cross-folding apparatus 35 and the guide channel 43 is carried over a separate driven sheave toward a side track 51 where the chain 45 is kept until needed again.

FIG. 1, collectively, illustrates an embodiment of the arrangement in accordance with the invention, for the mechanical threading of a paper web 1 into the folding apparatus proper. Only the paper web 1, the folding cone section 5, the upper folding roller 23 and the lower folding rollers 27 are shown as parts of the path of the paper web 1. The strip of adhesive tape 49 is attached to the beginning of the paper web 1 under an angle of about 30°. This strip is carried beyond the edge of the paper web 1 and ends in a loop 53 which is pushed over a finger 55 of the threading latch 47 attached to the roller chain 45 (FIGS. 1 and 1D). This side edge of the paper web 1, now under 30° against the bias is also reinforced with a strip of adhesive tape 57. So far the paper web 1 has been drawn by the roller chain 45 carried in the guide channel 43. The folding station or section 5 has a cutting fixture consisting of two cutting discs 59 and 61 (FIGS. 1, 1C and 1D) located near an edge 63 of the folding cone 5, by means of which the adhesive strip 49 is severed right at the edge of the paper web 1. The roller chain 45 continues on its path into the side track 51 and the paper web driven by the upper folding roller 23 slides now freely on its own over a guide plate, or baffle 65 forming part of the folding cone proper, of folding section 5 and continuing in the direction of the cone tip 67 at the point of the guiding baffle 65. An airstream flowing through the apertures at the edge 63 of the guide baffle 65 during the normal operation of the rotary printing press is shut off during this procedure.

Two auxiliary baffles 69 and 71 for the guiding of the paper web 1 are provided, extending from the edge 63 and from another edge 73 of the guide baffle 65, on the rear side of said baffle, to the gap 75 between the lower feed rollers 27 and converging toward it. Thus the appearance of a tetrahedron is created, formed by the folding former guide plate, or baffle 65 and the auxiliary baffles 69 and 71 is created. A system of airjets is arranged, somewhat below the plane of the folding former guide baffle 65 and away from the auxiliary baffles 69 and 71 consisting of manifolds 77, 79 and 81, 83 respectively (See FIGS. 1, collectively, and 3) by which an airstream is directed to the respective auxiliary baffles 69 and 71, with a small component of the airstream deflected also toward the respective edge of the paper web 1. As soon as the paper web 1 has reached the range of the airblast it is effectively directed toward the roller nip, or gap 75 of rollers 27; the air blast also serves to steady the paper web 1. Additionally the air blast creates a vacuum at its outer edge to grip the paper web now lying flat on the guide baffle 65 and to fold it around the folding edges 63 and 73. From this point on the paper web 1 driven by the upper folding roller 23 slides over due to the auxiliary blast itself. By means of this method the beginning of the paper web 1 can be reliably folded around the folding cone formed by baffle 65.

In this particular embodiment of the invention the air blast is delivered from the air channels 77 to 83, as illustrated separately on FIG. 3. This air channel 77 consists of a main body 85 with a longitudinal air duct 89 connected to a supply line 87. The air duct is closed up on both ends; on top it is covered with a plate 91. On the side opposite to the supply port the main body 85 has been relieved lengthwise so that a very narrow slot of about 0.05 mm width is created between the main body and the plate 91. At the outside of this channel the main body 85 extends beyond the edge of the plate 91 and the protruding part is chamfered or rounded off. As a consequence of these two features the air blast expelled by the manifold 77 is formed into a patterned, narrow stream and deflected by the chamfer 95 almost perpendicular toward the base of the main block 85, as shown by the direction of the arrow 97. These air slots are very efficient, exhibiting good pressure - and vacuum factors at relatively low air consumption. They can easily be swiveled into the direction required for an unimpeded web transport.

To prevent any contact between the paper web 1 and the auxiliary baffles 69 and 71 during the production run of the rotary printing press, which could result in smudging of the print the auxiliary baffles 69 and 71 are somewhat offset toward the inside of the cone edges 63 and 73. They could also be bent toward the inside or shaped into a slight arc. Smudging due to contact with the guide baffle 65 or from the cone edges 63 and 73 is inhibited by the well known method of providing air blasts at the proper stations.

Normally the lower feed rollers 27 are not provided with an independent driving mechanism, therefore the pressman has to set them into rotation with his hands when threading the paper web, a procedure bound to lead to accidents. For the automatic threading method, a driven system has been incorporated. In this particular embodiment this drive is supplied by air nozzles 99 on each side of the cone wedge 67 which are adjusted in such a manner that air jets blowing tangentially to the lower feed rollers 27 and into the gap 75 between them impinge open the knurled surface of those lower feed rollers 27, thus providing the power for their rotation.

The effect of the air manifolds 77 to 83 can be further increased through the use of the generally known transport bands 92. These bands can be placed on the surface of the auxiliary baffles 69 and 71 and when directed, see arrow toward the gap 75 will add rigidity to the paper web 1, preferably when placed under an angle against the edge of the paper web 1. On their surface these transport bands can be provided with a great number of apertures which are connected to a vacuum chamber located behind the outer rim of each transport band. By means of the suction action and the ensuing attractive force created at the rim of a moving transport band, the gripping, folding and transporting of the beginning of the paper web 1 is greatly facilitated and can even be thereby taken over completely. But these transport bands are relatively expensive in comparison to the air jet arrangement, also not necessary due to the very effective performance of the air jets.

Rollers 27 are driven by an air blast, that is, by a drive arrangement which permits slip with respects to the driving force. This slip is sufficient to prevent injury to the operator if, by chance, his fingers should get caught in the rollers; the force is, however, sufficiently strong to pull the paper through upon initial threading.

Various change and modifications may be made within the scope of the inventive concept.

We claim:

1. Apparatus to thread a paper web into the folding mechanism of a rotary printing press having a folding former (5,65);

driven supply rollers (23,25) upstream of the folding former to supply a web of paper (1) thereto;

two take up rollers (27) downstream of the folding former and having their axes located at right angles to the supply rollers (23,25), and forming a nip (75) there between;

and comprising, in accordance with the invention two paper guide baffles (69,71) located at the back side of the folding former (5,65) extending in converging direction from the edges of the former to the tip (67) of the former and up to the nip (75) between the take-up rollers (27);

air pressure differential generating means (77,79, 81,83) generating an under pressure adjacent to the surfaces of the guide baffles (69,71) of sufficient intensity to pull the paper web (1) over the edges (63,73) of the former and into the nip (75) between the take-up rollers (27);

and means (29,99) acting on the take-up rollers providing rotational force thereto to provide for driving force by said take-up roller on the paper web (1) introduced in the nip between said rollers upon threading of the web over the former.

2. Apparatus according to claim 1 wherein the air pressure differential generating means comprises elongated air pressure nozzles (77 to 83) located on either side of the former (5) and spaced from the plane of the structure thereof, the nozzles being spaced from the guide baffles (69,71) and having a nozzle path which is inclined with respect to the guide baffles so that at least a component of the air stream from the nozzles has a vectorial component which is at right angles to the nip (75) between the take-up rollers (27).

3. Apparatus according to claim 2 wherein the direction of inclination of the nozzles (77–83) is positioned so that the component of the air stream from the nozzles is directed at right angles with respect to the longitudinal edge of the paper web (1) being folded over the former (5,65) and towards the guide baffles (69,71).

4. Apparatus according to claim 2 wherein the nozzles (77–83) comprise an elongated structure having an elongated nozzle slit (93), the slit being defined by two parallel elements (85,91), the edge of one of said elements being formed with a chamfer (95) to provide for the deflection of said air stream in approximately perpendicular direction with respect to the nozzle.

5. Apparatus according to claim 1 wherein the guide baffles (69,71) are recessed inwardly, or backwardly with respect to the edges of the former (5,65) to prevent contact of the paper web with said guide baffles when the printing press is regularly operating and after threading, and when the paper web is tensioned for regular printing press operation.

6. Apparatus according to claim 1 wherein the means acting on a take-up rollers (27) and providing rotational force thereto comprises a knurling (29) formed on the surface of the take-up rollers (27) and at least one air blast nozzle (99) having an air stream directed inwardly towards the nip, and essentially tangentially with respect to the surface of the knurl of the rollers to provide driving power for said rollers by turbine action of the air blast against the knurling of the surface of the respective roller.

7. Apparatus according to claim 1 wherein the printing press includes means for (43,45,47) for mechanized threading of the paper web through the printing press, and including a pulling carrier (47) engageable with a paper strip (49) connected to said paper web to pull the paper web through the press and thereby thread the paper web through the press, and wherein said apparatus further includes severing means (59,61) located adjacent at least one of the edges (63,73) of the former (5,65) to severe the pulling strip (49) from the web.

8. Apparatus according to claim 7 wherein the severing means comprises two co-operating cutting wheels (59,61), and said paper strip comprises an adhesive strip adhered to the initial portions of the web.

9. Apparatus according to claim 1 further including endless transport belts (92) located on each side of the former (5) and in the plane of the guide baffles (69,71), the endless transport belts (92) extending essentially perpendicularly to the nip (75) between the take-up rollers (27).

10. Apparatus according to claim 9 further comprising a suction chamber (91) located behind the run of the transport belt exposed to the paper;

and openings formed in the transport belts to apply suction of the paper against the transport belts from the suction chamber.

11. Apparatus according to claim 9 wherein said transport belts are inclined slightly towards the direction of the respective longitudinal edge of paper web.

* * * * *